US006237611B1

(12) United States Patent
LeCrone et al.

(10) Patent No.: US 6,237,611 B1
(45) Date of Patent: May 29, 2001

(54) ORNAMENTAL BANDED CLOTHING DEVICE RECEIVING INTERCHANGEABLE ORNAMENTATION

(76) Inventors: Vicki LeCrone; Denise Hall, both of 221 Cozumel, Laguna Beach, CA (US) 92651

( * ) Notice: Subject to any disclaimer, the term of this patent is extended or adjusted under 35 U.S.C. 154(b) by 0 days.

(21) Appl. No.: 09/137,339

(22) Filed: Aug. 20, 1998

(51) Int. Cl.[7] ..... A45D 8/12
(52) U.S. Cl. ..... 132/275
(58) Field of Search ..... 132/275, 273, 132/174; 2/DIG. 11, 170; D28/41

(56) References Cited

U.S. PATENT DOCUMENTS

| | | | | |
|---|---|---|---|---|
| D. 335,023 | * | 4/1993 | Hutcheson | 2/170 |
| D. 347,733 | * | 6/1994 | Miller | 2/170 |
| 1,766,604 | * | 6/1930 | Cohen | 2/170 |
| 2,604,629 | * | 7/1952 | Kennedy | 2/170 |
| 3,211,160 | * | 10/1965 | Miller | 132/275 |
| 4,462,116 | * | 7/1984 | Sanzone et al. | 2/170 |
| 5,144,696 | | 9/1992 | Kahl . | |
| 5,156,171 | | 10/1992 | Goodman . | |
| 5,388,598 | * | 2/1995 | Whitten | 132/275 |
| 5,413,126 | * | 5/1995 | Revson | 132/273 |
| 5,456,274 | * | 10/1995 | Selbee et al. | 132/275 |
| 5,655,224 | | 8/1997 | Sears . | |
| 5,706,836 | | 1/1998 | McKeown . | |
| 5,826,598 | * | 10/1998 | Meehan | 132/275 |
| 5,911,227 | * | 6/1999 | Shweky | 132/275 |

* cited by examiner

*Primary Examiner*—Todd E. Manahan
(74) *Attorney, Agent, or Firm*—Stroock & Stroock & Lavan LLP

(57) ABSTRACT

A banded clothing device, the band made of a tubular fabric structure having at least one pocket in the longitudinal plane the pocket providing a means for interchangeably receiving ornaments or other objects. Also disclosed is the method for making the device and manner of using the device.

6 Claims, 4 Drawing Sheets

ORNAMENTAL BANDED CLOTHING DEVICE RECEIVING INTERCHANGEABLE ORNAMENTATION

BACKGROUND—FIELD OF INVENTION

The present invention relates to an ornamental and functional banded clothing device used to adorn a wearer as the wearer desires. More particularly, the present invention relates to a fabric band, such as hairbands, hatbands and waistbands, wherein the functional utility of the device includes an improved means for interchangeably receiving ornaments within said band.

BACKGROUND—DESCRIPTION OF PRIOR ART

Wherever there are women and mothers of little girls, fashionable accessorization continues to be an ongoing demand and challenge. While the band basics, such as headbands, hatbands, and waistbands, remain essentially unchanged, ornamental applications such as hair bows, flowers, ribbons, beads, or even favorite cartoon or movie characters are constantly changing trends. This can become an economic nightmare for consumers since trendy accessorization may be costly and limited to one application.

Recognizing that headbands, hatbands and waistbands are unchanging, the inventors of this patent have improved upon the classics and developed a novel way to change accessories while retaining the basics. In so doing, they have solved the single-use limitation problem and provided an invention which will stand the test of time and gives the consumer cost-effective versatility in trendy accessorization.

Banded clothing devices are well known in the prior arts. However, such disclosures are limited in that the ornamentation is glued or sewn to the existing device. This limits the wearer to a single-use application and make versatility or flexibility impossible.

Prior disclosures have not adequately addressed the issue of the single-use limitation. A patent for a hair ornament and hair-control device securing assembly was set forth in U.S. Pat. No. 5,706,836, issued to McKeowen in 1998. This device describes a ™ hook and loop means for securing hair ornaments to various hair-control devices. This mating of the strips of hook and loop fasteners, however, does have the limitation of causing the hair to get caught and pull, and can be painful to the wearer. Even worse is the appearance. By placing the ornament atop the ™ strip, one is faced with an ornament which does not lie flat. Rather, the ornament protrudes in a very unattractive manner from the restraining device. Another problem is that over time the velcro will weaken in its ability to adhere. Finally, it has been this inventor's experience, as one skilled in the hair ornamentation arts, that a ™ strip is very difficult to sew in place and if glued in place, will loosen after repeated use.

Another patent for a detachable flower wire tie device, U.S. Pat. No. 5,655,224, which was issued to Sears in 1997, describes a detachable flower wire tie including a fabric stem enclosing a pliable metal wire. Although the wire tie, having a twisting means is easy to use and inexpensive to manufacture, nevertheless, it does not possess the flexibility nor the adaptability as set forth in this disclosure. While patent ,224 may be used as a headband, hatband, and waistband, nevertheless, the invention is limited to one entity, a flower, exclusively. In addition, the wire is stiff and due to the inherent stiffness is limited in its pliability and adaptability.

None of the above inventions and patents adequately solve the problem. It is obvious that a clear need exists for a banded clothing device which not only facilitates an important function but also provides a efficient, simple and cost-effective means for interchangeable ornamentation and accessorization. To this end, the teaching of the present invention embraces and finally addresses this longstanding and unmet need.

SUMMARY OF THE INVENTION

The apparatus and method of this invention have several features, no single one of which is solely responsible for its desirable attributes. Without limiting the scope of this invention as expressed by the claims which follow, its more prominent features will now be discussed briefly. After considering this discussion, and particularly after reading the section entitled "DETAILED DESCRIPTION OF THE PREFERRED EMBODIMENT," one will understand how the features of this invention provide its benefits and advantages.

Simply stated, the invention is a banded clothing device having a pocket. In the preferred embodiment, the band is made of a tubular fabric structure, the fabric of the structure must have at least one pleat, the pleat forming at least one pocket in the longitudinal plane of the banded clothing device.

It is the object of this invention to provide an ornamental and functional banded clothing device which overcomes the drawbacks of the prior art. The disclosure sets forth a novel invention having a means for receiving interchangeable ornamentation or other utility. Further, the disclosure describes a method for making and using the device. Additionally, several other objectives and advantages of the present invention are:

A. To provide a useful and cost-effective means for accessorizing one's wardrobe;

B. To provide an interchangeable ornamental and functional device for restraining the hair;

C. To provide an interchangeable ornamental and functional device for dressing a hat;

D. To provide an interchangeable ornamental and functional device for adorning a waist;

E. To provide a classic banded clothing device having a superior means for receiving ornamentation in a reusable, cost-effective, and interchangeable format;

F. To provide a device which can be manufactured in many different types of fabrics, colors, and styles;

G. To provide a device have the additional utility of providing a means for receiving objects other than just ornamentation.

Furthermore, the disclosure which is the subject of this invention, will describe in detail how the device is made to enable one skilled in the art to practice the invention. The disclosure will detail how to sew together woven fabric in such a manner so as to create a generally tubular structure, know in the art as a band. Prior to sewing the tubular structure, there is created in the fabric one or a plurality of pleats. The pleat or pleats form one or a plurality of pockets in the longitudinal plane of the device. The pocket or pockets provide a means for receiving ornaments. Such ornamentation may be in the form of clips, barrettes, hair pins, hat pins, or bobby pins having ornamentation such as bows, ribbons, flowers, dirndls, and the like affixed thereon to either match or coordinate with the fabric of the device. The device may be worn without the interchangeable ornamentation and the interchangeable ornamentation may be worn without the device. In addition, the pockets or pockets created with this invention have the additional utility providing a means for receiving other objects such as lunch money, bus tokens, cosmetics and the like, therein.

This invention is simple to use and depending upon the fabric selected is generally inexpensive to manufacture. The invention can be used repeatedly and provides the wearer with wardrobe ornamentation versatility never before achieved. Still further other objectives and advantages will become apparent from a consideration of the ensuing description and drawings.

BRIEF DESCRIPTION OF THE DRAWINGS

The preferred embodiment of this invention, illustrating all its features, will now be discussed in detail. The embodiment depicts the novel and non-obvious ornamental and functional banded clothing device having one or a plurality of pockets for receiving interchangeably decorative ornamentation or other functional objects. The accompanying drawings, which are for illustrative purposes only, include the following figures (FIGS.), with like numerals indicating like parts.

DESCRIPTION OF THE PREFERRED EMBODIMENT

Simply stated, the invention is a banded clothing device, the band is made of a tubular fabric structure having at least one pocket in the longitudinal plane. All embodiments of the banded clothing device have the same novel invention.

In the preferred embodiment, the fabric of the tubular structure must have at least one pleat, the pleat forming at least one pocket in the longitudinal plane of the banded clothing device. The tubular structure is usually sewn with one or two pieces of fabric, however more may be used if desired. The fabric may be yardage or ribbon. The fabric may be sewn right sides together, creating a seam or seams on the inside, or wrong sides together, creating a seam or seams on the outside. The interior of the tubular structure may have elastic, plastic or other malleable substances, or absolutely nothing inside. The length of the fabric is not relevant to the invention. The width of the fabric band is not relevant to the invention.

Figure 1:
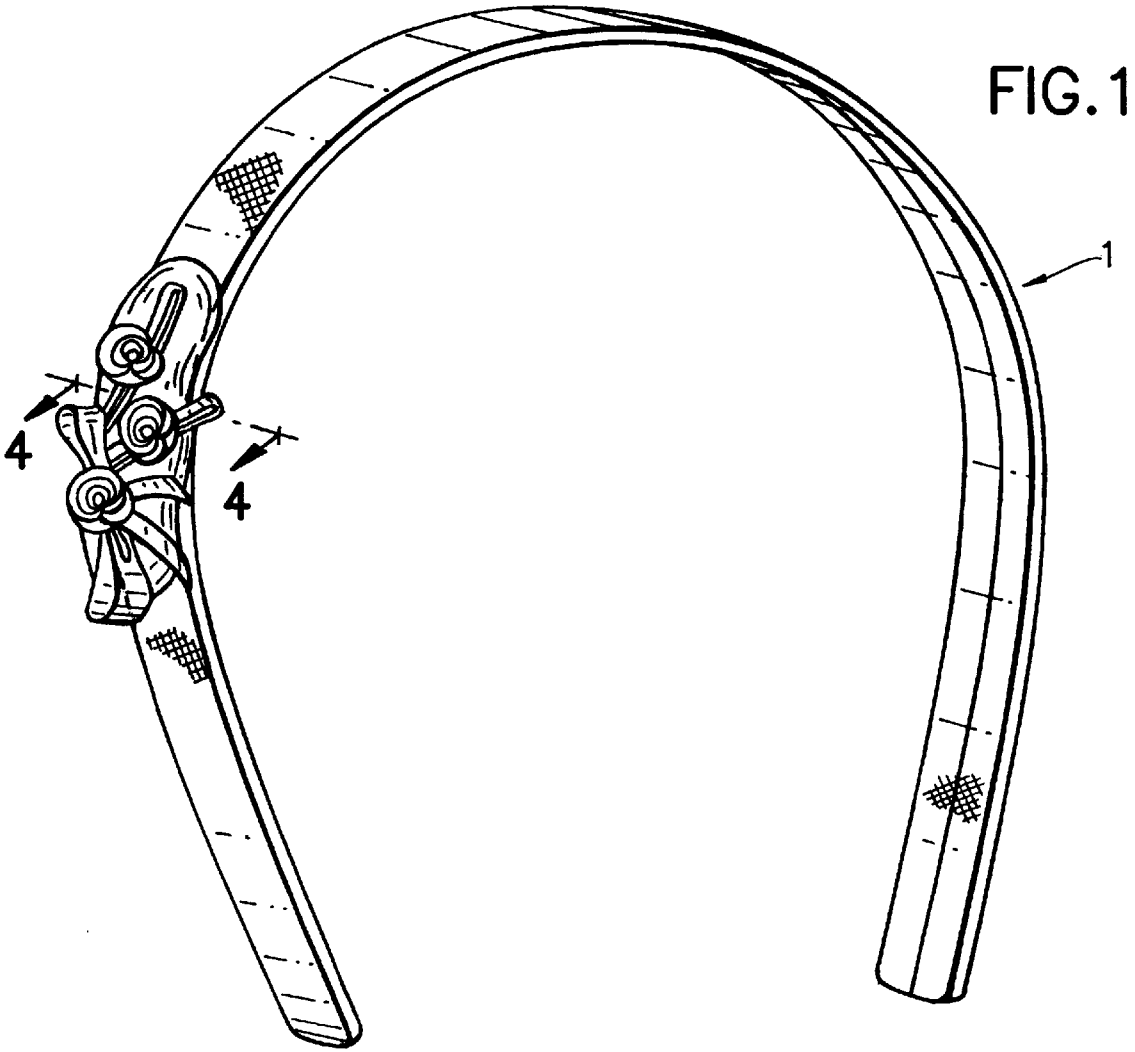
FIG. 1 shows a perspective view of the invention, shown as a headband, having a pocket for receiving ornamentation, shown in the figure as a decorative clip.
Figure 2:
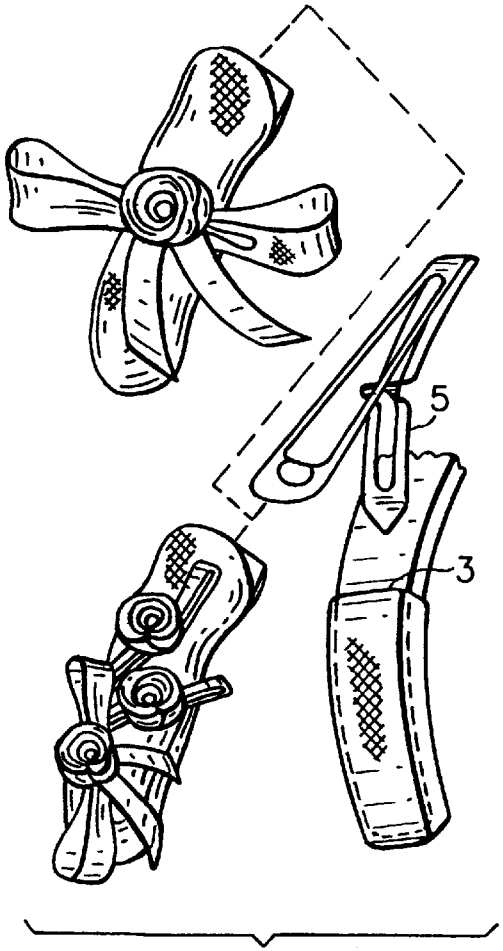
FIG. 2 depicts a perspective assembly view of ornamentation being affixed to the top of a clip, the ornamental clip being received into the pocket of the invention, depicted here as a headband.

In FIG. 1, a banded clothing device 1, forming the novelty of the invention, is fit to cover a common headband. Headbands of this type may be constructed of any malleable substance, however, they are generally made of plastic or metal. The manner of pleating the fabric and sewing the banded clothing device 1 forms the basis of the preferred embodiment of this patent. As you will see in FIGS. 1 and 2, a pocket 3 is formed in the banded clothing device 1. The pocket 3, which is required to practice this invention, provides a means for receiving the interchangeable ornamentation. Further, FIG. 2 depicts the assembly of how an interchangeable ornament, shown here as a clip 5, is received into the pocket 3 ofthe banded clothing device 1.

An example of one way to make the invention, which is not intended to be a limitation, is set forth as follows. A covered headband such as the one shown in FIG. 1 is formed of a strip of fabric being 16 ½ inches in length by 2 ¼ inches in width. The fabric has a first end and a second end. At about 5 ½" inches from the center of the lengthwise fabric, a pleat is formed. The pleat is folded in the transverse plane to lie upon the fabric in the longitudinal plane back toward the first end of the fabric. The depth of the pleat is determined by the length of the locking means of the barrette or clip, however, generally a pleat approximately 1 ½" to 2" is sufficient. In this example, the pleated fabric is then folded, right sides together, along its longitudinal plane and joined together by a row of stitches forming a tube, leaving at least one end open. The fabric is then turned right side out, and flattened placing the seam to the underside of the tube, and the pleat now having formed a pocket. A 1-inch plastic headband is then threaded into the opening in the first end of the fabric. Turning the raw edges of the fabric tube into the opening then finishes the open end of the fabric tube. The opening may then be stitched closed. The pocket that has been created by the pleat provides a means for holding the ornamental clip, pins or barrette in the same plane and tightly against the headband.

Figure 3:
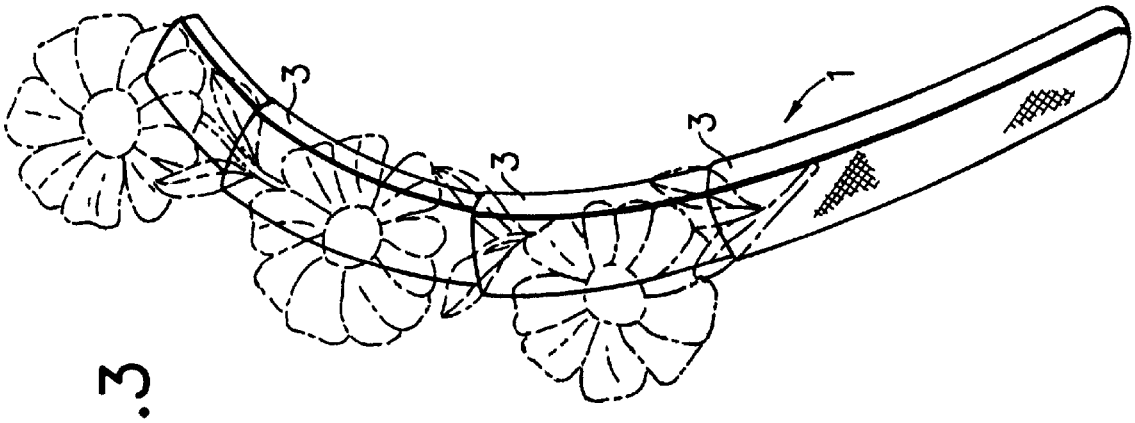
FIG. 3 shows a perspective view of the invention having a plurality of pockets for receiving ornamentation.

As depicted in FIG. 3, the banded clothing device of this invention may have a plurality of pockets 3 for receiving a plurality of ornaments 5. In the same manner as set forth above, this embodiment is created by folding a plurality of pleats into the fabric prior to stitching the fabric in the longitudinal plane.

An alternate way, again not intended to be limiting, of creating the tubular structure forming the banded clothing device of this invention is with two strips of fabric. As an example, one being a ¾" wide strip and a second being ½" wide. Again, a pleat or pleats is formed in the first strip as described above. The two strips of fabric are then joined by rows of stitches along the upper and lower longitudinal planes leaving at least one end opened. Again, the pleat or pleats form one or a plurality of pockets for receiving ornamental barrettes or clips therein. A malleable headband or elastic may or may not be threaded into the interior of the tubular structure.

Figure 4:
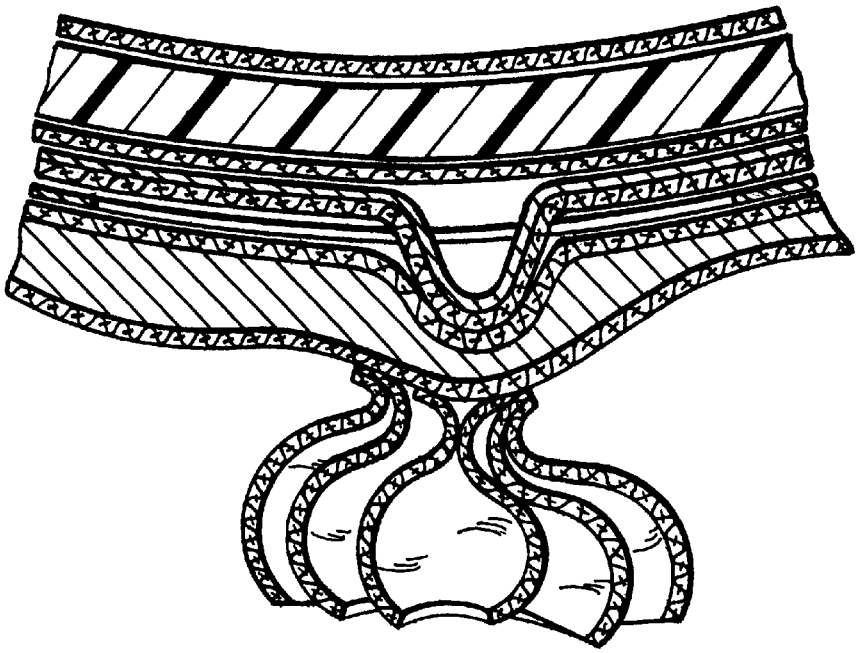
FIG. 4 is a cross-sectional view of the ornamentation received into the pocket.

FIG. 4 is a cross-sectional drawing shows the manner in which the clip is received between the layers of fabric forming the pocket and having its ornamentation on the exterior surface of the headband.

Figure 5:
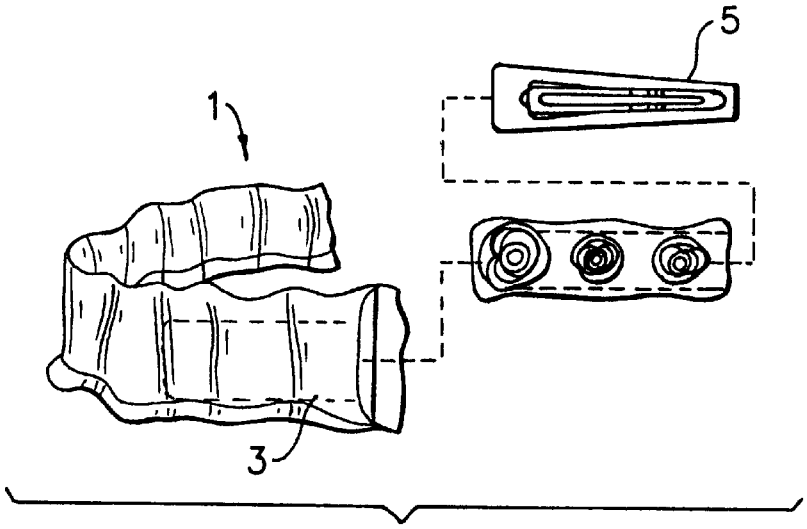
FIG. 5 is the invention of use as a hatband or waistband.

Another embodiment of the invention is depicted in FIG. 5. Here, again is shown the pleated, pocketed fabric tubular structure of the banded clothing device having a means for receiving interchangeable ornamentation. The under side of the fabric tube could have a loop for receiving the first end of the tube into and through said loop or other manner for securing the first end of the device to the device. The interior surface of the tubular structure may or may not have elastic. It is suggested that this embodiment may be used as a hatband or a waistband. This embodiment is so designed so as to be adjustable to many differing hat circumferences and variations in waist measurements.

Figure 7:
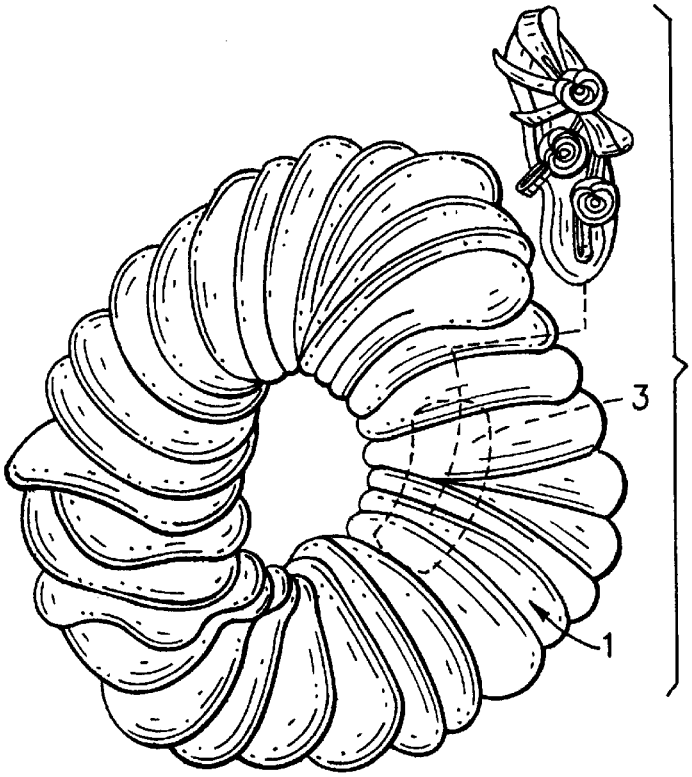
FIG. 7 is a perspective depiction of the device having elastic within the interior of the tubular structure.

Another embodiment of the pleated, pocketed, fabric tubular structure of the banded clothing device having a means for receiving interchangeable ornamentation is shown in FIG. 7 with the insertion of elastic inside the tubular structure. An example, not a limitation, as to how to practice this embodiment is to join the first end of the pleated fabric tubular structure to the second end of the pleated tubular fabric forming a circle having one or a plurality of pockets. An opening is left in the stitching wherein a length of elastic is threaded through the pleated fabric circle joining the first end of the elastic to the second end of the elastic fabric forming an elastic circle within the fabric circle. The opening is then stitched shut.

In another example of how to practice this embodiment, not intended to be a limitation, a ⅞" ribbon is place wrong sides together with a ¾" ribbon. The wider ribbon having a pleated pocket as set forth in all the above embodiments. Then the two ribbons are stitched together forming a tubular casing through which elastic is then threaded thereafter attaching the first end of the elastic to the second end of the elastic forming a circle. And the first end of the ribbon may be attached to the second end of the ribbon forming a circle. If the elastic is omitted and the first and second ends are not attached to one another, the inner chamber of the tubular device may receive a malleable headband. This method of assembling the invention can provide a fringed edge along the outer surfaces of either the elastic headband or the hard headband while in either form while still providing the pocket for receiving interchangeable ornamentation. This fringed edge is particularly adorable and commercially appealing if the ribbon or fabric selected has a lace edge.

Figure 8:
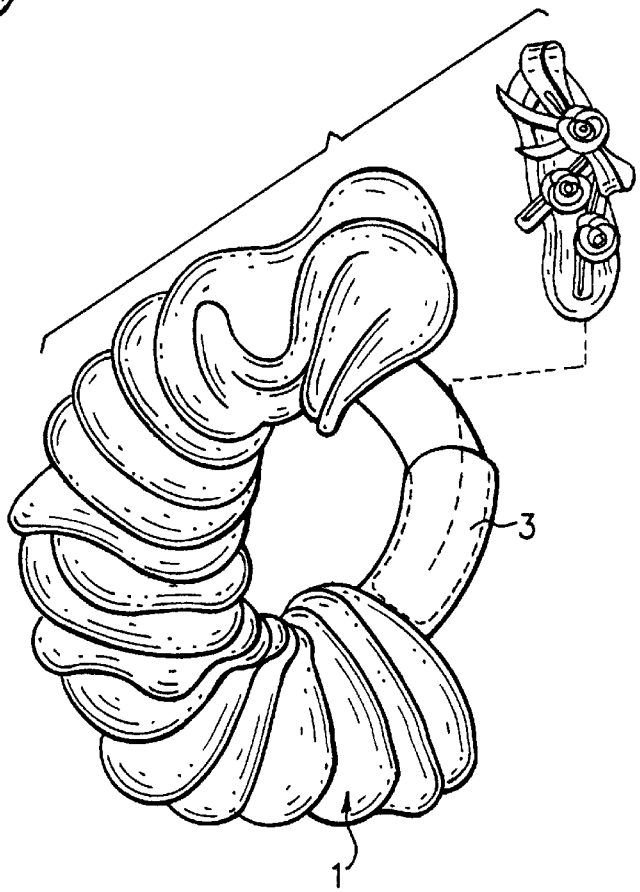
FIG. 8 is a perspective depiction of the device having elastic within the interior of the tubular structure and having a flattened area in front of the receiving pocket.

Another form of this embodiment, as shown in FIG. 8, provides a flattened area having a pocket for receiving the clip or barrette. The flattened area permits the ornamentation to be seated tightly and flatly upon the fabric covered elastic circle yielding a desirable appearance which is once again functional as well as ornamental. To create this embodiment, one sews the device as set forth above for the elastic headband. However, one final step is required. At a place in front of the pocket, the fabric is folded in half and stitched down to provide a flat surface in front of the pocket.

Figure 6:
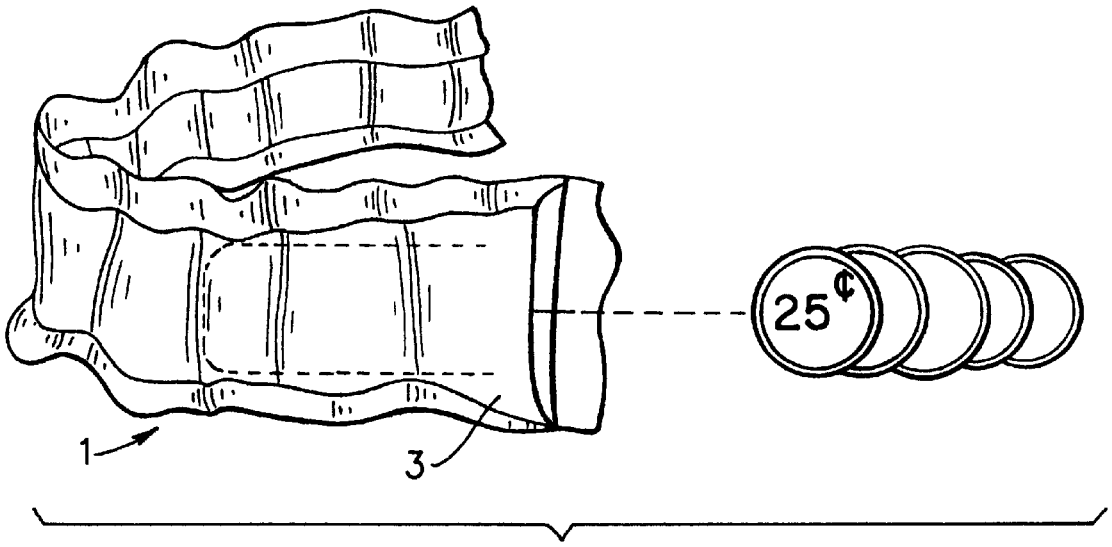
FIG. 6 depicts objects being received into the pocket.

FIG. 6 suggests the use of the pocket, as set forth in the invention, for receiving money or other objects the wearer may want to carry with her but not be bothered with a purse or wallet. In this manner, the pocket provides a novel means for carrying objects or for hiding money such as at school or during travel.

To use device the wearer inserts such interchangeable ornamentation as barrettes, clips, decorated pins, ornamental bobby pins, and the like into the pocket or pockets creating the decorative look desired. In addition, the device may be worn independently of the ornamentation.

SCOPE OF THE INVENTION

The above-presented description of the best mode contemplated of carrying out the present invention and of the manner and process with making and using it is in such a full, clear, concise and exact terms as to enable to any person skilled in the art to which it pertains to make and use this invention.

This invention is however, susceptible to modifications and alternate constructions from that disclosed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims which particularly point out and distinctly claim the subject matter of the invention:

We claim:

1. A banded clothing device having an exterior surface and at least one pocket, said exterior surface generally facing away from a center of said banded clothing device, said pocket being located on the exterior surface of said banded clothing device, wherein said banded clothing device defining a length as measured in a longitudinal direction, said pocket being flattened in the longitudinal direction and having a limited depth in the longitudinal direction which is less than the length of the banded clothing device, and said pocket being shaped and sized for receiving at least a portion of an interchangeable functional or ornamental object in such a manner that a visible portion of said object protrudes from said pocket and is visible on said surface.

2. The banded clothing device of claim 1 further comprising a first surface, said pocket comprising a cavity formed in said first surface.

3. The banded clothing device of claim 1 wherein said cavity is an elongated cavity.

4. The banded clothing device of claim 2 wherein said first surface is comprised of a foldable material and wherein the cavity is formed by creating a fold in the material of the clothing device and securing two sides of the fold and leaving one side open.

5. The banded clothing device of claim 1 wherein the ornamnental object is a hair accessory.

6. The banded clothing device of claim 1 wherein the banded clothing device is a hairband.

* * * * *